United States Patent [19]

Toedtman

[11] Patent Number: 4,988,308

[45] Date of Patent: Jan. 29, 1991

[54] FLOATING PANEL MOUNTS FOR ELECTRICAL CONNECTORS

[75] Inventor: Thomas N. Toedtman, Cupertino, Calif.

[73] Assignee: Molex Incorporated, Lisle, Ill.

[21] Appl. No.: 559,541

[22] Filed: Jul. 23, 1990

Related U.S. Application Data

[63] Continuation of Ser. No. 467,629, Jan. 19, 1990, abandoned.

[51] Int. Cl.[5] ..... H01R 13/74

[52] U.S. Cl. ..... 439/248; 439/557; 248/27.3; 411/508

[58] Field of Search ..... 248/27.3, 221.4; 411/508; 439/247, 248, 547, 549, 552, 554, 557, 558, 562, 565, 567, 569, 571, 572

[56] References Cited

U.S. PATENT DOCUMENTS

| | | | |
|---|---|---|---|
| 3,177,540 | 4/1965 | Hall et al. | 411/508 |
| 3,213,189 | 10/1965 | Mitchell et al. | 248/27.1 |
| 3,514,743 | 5/1970 | Schantz | 439/557 |
| 3,543,219 | 11/1970 | Pautrie | 439/358 |
| 3,654,353 | 2/1972 | Cope et al. | 248/27.1 |
| 3,776,495 | 12/1973 | Hartz et al. | 411/508 |
| 4,589,794 | 5/1986 | Sugiura et al. | 439/571 |
| 4,647,130 | 3/1987 | Blair et al. | 439/248 |
| 4,668,145 | 5/1987 | Hirohata | 411/508 |
| 4,820,180 | 4/1989 | Mosquera et al. | 439/248 |

FOREIGN PATENT DOCUMENTS

| | | | |
|---|---|---|---|
| 283799 | 10/1966 | Australia | 411/508 |
| 258382 | 3/1967 | Fed. Rep. of Germany . | |
| 2547951 | 5/1977 | Fed. Rep. of Germany . | |
| 1342218 | 9/1963 | France | 411/508 |
| 1375585 | 9/1964 | France | 411/508 |

OTHER PUBLICATIONS

IBM Technical Disclosure Bulletin, "Interchangeable Means for Holding a Circuit Card to a Framework", vol. 29, No. 9, Feb. 1987, pp. 4094.

*Primary Examiner*—Gary F. Paumen

*Attorney, Agent, or Firm*—Louis A. Hecht; Charles S. Cohen; Stephen Z. Weiss

[57] ABSTRACT

A floating panel mount for an electrical connector is provided. The floating panel mount includes a central support post from which a pair of helically configured inwardly collapsible vanes extend. The vanes are tapered to define a minor cross sectional dimension less than the diameter of a mounting aperture in the panel and a major dimension which exceeds the diameter of the mounting aperture. The vanes are helically collapsed in response to ramping forces generated as the floating panel mount is urged into the mounting aperture of the panel. The vanes then resiliently return to their undeflected condition to engage the panel. In this mounted condition, the vanes permit radial float of the electrical connector relative to the panel, but prevent backup in response to mating forces.

20 Claims, 3 Drawing Sheets

FLOATING PANEL MOUNTS FOR ELECTRICAL CONNECTORS

This application is a continuation of application Ser. No. 467,629, filed Jan. 19, 1990, now abandoned.

BACKGROUND OF THE INVENTION

Panel mounted electrical connectors comprise a non-conductive or dielectric housing having at least one electrically conductive terminal mounted therein. The housing also includes or is adapted to receive means for mounting the housing to a panel. The panel mounted connector is mateable with other circuitry, such as another connector, which, in turn, may be mounted to a second panel, a cable or discrete wires.

The mating of a panel mounted electrical connector to another circuit component often is carried out under blind mating conditions such that precise alignment of the panel mounted connector with the other circuit components can not be assured. Blind mating of panel mounted connectors may occur with components of photostatic copiers, computer equipment and telecommunications equipment. An attempt to forcibly blind mate improperly aligned electrical connectors can damage the housing of the connector, the fragile terminals in the housing or the panels to which the connectors are mounted. Improper alignment may also prevent complete mating, thereby negatively affecting the quality of the electrical connection.

Many prior art panel mounted electrical connectors are provided with means for permitting a controlled amount of float between the connector housing and the associated panel. Most prior art means for permitting float between the panel and the electrical connector housing have been fairly complex multi-component structures that are manufactured separately from the electrical connector, and that require complex assembly and installation. An example of such a floating panel mount is shown in U.S. Pat. No. 4,647,130.

Other prior art floating panel mount connectors include a plurality of components that can be assembled to one another from opposite sides of the panel. These prior art connectors typically include spacers which prevent tight engagement of the connector components to the panel. Thus, the assembled components permit a controlled amount of float relative to the panel about which they are assembled. An example of such a connector is shown in U.S. Pat. No. 3,645,353 which issued to Cope et al on Feb. 29, 1972. Connectors of this type are undesirable in that the plural components required for the connector require complex assembly and substantially increase the cost of the connector. In this regard, it is important to emphasize that the electrical connector industry is extremely competitive, and even small savings in cost can be an extremely significant advantage.

Other floating panel mount connectors merely include a pair of angularly aligned deflectable latch arms that are mounted respectively to opposite sides of the housing, and that deflect upon insertion of the connector into the panel. The latch arms are dimensioned to pass through an aperture in the panel at the connector approaches its fully seated condition. The deflectable latch arms are then resiliently returned to their original alignment such that the ends of the latch arms will engage one side of the panel. Thus, the deflectable latch arms are intended to prevent separation of the connector from the panel while still permitting a limited amount of float between the connector and the panel. Examples of this prior art are shown in U.S. Pat. No. 3,213,189 which issued to Mitchell et al on Oct. 19, 1965; U.S. Pat. No. 3,514,743 which issued to Schampz on May 26, 1970; and U.S. Pat. No. 3,543,219 which issued to Pautrie on Nov. 24, 1970. Similar prior art structures are shown in German Patent No. 258,382 dated Nov. 27, 1967 and German Patent No. 2,547,951 dated May 5, 1977. Still another similar structure is shown in IBM Technical Disclosure Bulletin entitled "Interchangeable Means for Holding A Circuit Card to A Framework" dared February 1987.

The above described prior are floating panel mount connectors generally have been effective in retaining a connector to a panel. However, these prior art floating panel mount connectors often require significant forces to mount the connector to the panel. High mounting forces create the potential for damage to either the connector or to the panel. Attempts to reduce mounting forces by providing smaller more flexible deflectable latches create the potential for significant backup of the connector during mating. More particularly, the mating of the panel mounted connector to another circuit component generates mating forces as the electrically conductive connector terminals of the panel mounted connector engage the contact surfaces of the circuit component to which the panel mounted connector is mated. These high connector mating forces can cause the latches of the floating panel mount connector to deflect significantly and urge the panel mounted connector away from the circuit component connector with which it is mating. In some circumstances, this backup can prevent the panel mounted connector from mating fully with the other circuit component connectors.

An extremely effective prior art floating panel mount connector is shown in U.S. Pat. No. 4,820,180 which issued to Rene Mosquera and Wayne Zahlit on Apr. 11, 1989 and which is assigned to the assignee of the subject application. The floating panel mount disclosed in U.S. Pat. No. 4,820,180 includes at least one pair of opposed multiple cantilevered latch structures with each multiple cantilevered latch structure comprising a plurality of independently deflectable cantilevered arms. The independent multiple deflection of the cantilevered arms enables mounting of the connector to the panel with low mounting forces. The cross-sectional dimensions of the arms also enable significant float or the connector relative to the panel. However, the angular alignment of the deflectable arms relative to one another achieves secure mounting of the connector to the panel. The angular alignment of the arms in each latch structure or in each pair of latch structures facilitates the deflection of the arms for selective removal of the connector from the panel. Other preferred features of the floating panel mount connector of U.S. Pat. No. 4,820,180 are disclosed in that specification, the disclosure of which is incorporated herein by reference.

Although the floating panel mount electrical connector of U.S. Pat. No. 4,820,180 is extremely effective, it is desirable to provide a floating panel mount that exhibits even less backup during mating, while still exhibiting the other desirable features of the floating panel mount disclosed in U.S. Pat. No. 4,820,180, including low mounting forces and significant float.

In view of the above, it is an object of the subject invention to provide a floating panel mount that facilitates mounting of an electrical connector to a panel.

It is another object of the subject invention to provide a floating panel mount that enables a significant amount of float of the connector relative to the panel to achieve proper alignment of the panel mounted connector with another circuit component during mating.

It is an additional object of the subject invention to provide a floating panel mount for an electrical connector that readily permits selective separation of the connector from the panel.

Still an additional object of the subject invention is to provide a floating panel mount for an electrical connector that substantially minimizes backup of the connector relative to the panel during mating.

SUMMARY OF THE INVENTION

The subject invention is directed to a floating panel mount for an electrical connector. The floating panel mount of the subject invention may be unitarily molded with the housing of a panel mounted electrical connector, or may be selectively employed with a panel mountable electrical connector having means for receiving and engaging the subject floating panel mount structure. The floating panel mount and the associated electrical connector are employable with a panel having a mounting aperture extending therethrough.

The floating panel mount of the subject invention comprises a base disposed to extend substantially parallel to the panel to which the connector is mounted. The base may be unitarily molded with the mounting flange on the panel mountable electrical connector. The floating panel mount further comprises a post extending from the base and/or from the mounting flange of the connector. The post typically will extend substantially orthogonally from the base. The post defines cross-sectional dimensions which are significantly less than the cross-sectional dimensions of the mounting aperture extending through the panel to which the electrical connector is mounted. The relative differences between the cross-sectional dimensions of the post and the cross-sectional dimensions of the mounting aperture are selected in accordance with the amount of float that is preferred to exist therebetween. The length of the post is substantially greater than the thickness of the panel to which the connector is mounted.

The floating panel mount of the subject invention, further comprises at least one deflectable spiral vane which extends from the post. The vane may be configured to deflect helically spirally inwardly and toward the post upon insertion of the floating panel mount into the mounting aperture of the panel. More particularly, the vane may be of tapered or generally triangular configuration to define a minor width at portions thereon remote from the base and to define progressively greater widths at locations thereon closer to the base. Portions of the vane spaced from the mounting post may be arcuate to facilitate the inward collapsing of the vane relative to the post. In particular, the vane may define a helically spirally configured outer edge and/or helically formed surfaces extending from the post to the outer edge. The shape of the vane is selected in accordance with the material from which the vane is formed and the relative dimensions of the vane. The shape and dimensions of the vane are selected to ensure inward collapsing of the vane relative to the post in response to relatively low forces generated as the post and the vane are urged through the mounting aperture in the panel.

The trailing end of the vane defines a panel engaging surface. The panel engaging surface is spaced from the base of the floating panel mount and/or from the mounting flange of the connector by a distance which is equal to or greater than the thickness of the panel to which the connector is mounted. The spacing between the trailing end of the vane and the base of the floating panel mount will determine the amount of backup permitted during mating of the connector with other surface components.

Preferably, the floating panel mount comprises a plurality of vanes extending from the post. The vanes preferably are disposed generally symmetrically relative to the post to substantially minimize deflection of the post in response to mating forces. Additionally, the vanes preferably are configured to deflect in generally opposite directions relative to the post in response to the forces exerted thereon during mounting onto the panel. In particular, the vanes may be configured to deflect generally helically inwardly towards the post in response to the forces generated between the vanes and the panel during mounting of the electrical connector to the panel. The vanes are configured to progressively deflect inwardly as the connector is mounted to the panel. However, upon sufficient insertion into the panel, the trailing surface of each vane will clear the panel, thereby enabling the vanes to resiliently return to their original configuration. This resilient return of each vane to its original configuration will cause the trailing surface of the vane to engage a surface of the panel.

The floating panel mount is constructed to facilitate the selective separation of the connector from the panel. More particularly, relatively minor pressure exerted by a thumb and forefinger on the vane will enable sufficient inward collapsing of the vane toward the post to enable the collapsed vanes to pass back through the mounting aperture in the panel.

Preferably, the floating panel mount is unitarily molded with the housing of an electrical connector. More particularly, in a preferred embodiment as described and illustrated further below, there are a plurality of floating panel mounts unitarily molded with the housing of the electrical connector. In these preferred embodiments, each post extends unitarily from the mounting flange of the electrical connector housing and is substantially orthogonal thereto. Each such mounting post further comprises a plurality of vanes configured to deflect generally inwardly toward the post in response to the forces generated on the vane by the panel at the electrical connector housing is urged into a mounted position on the panel.

DETAILED DESCRIPTION OF THE PREFERRED EMBODIMENT

Figure 1:
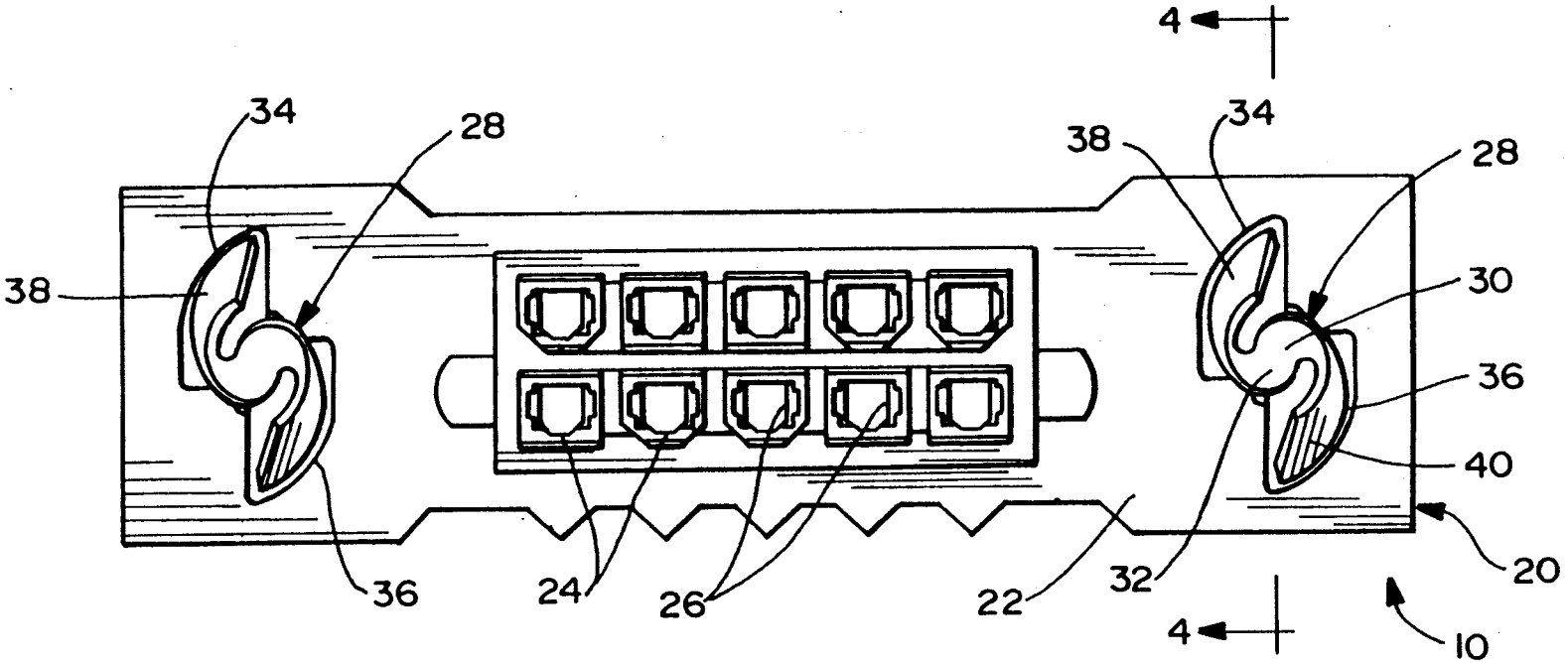
FIG. 1 is a top plan view of an electrical connector employing the floating panel mount of the subject invention.
Figure 2:
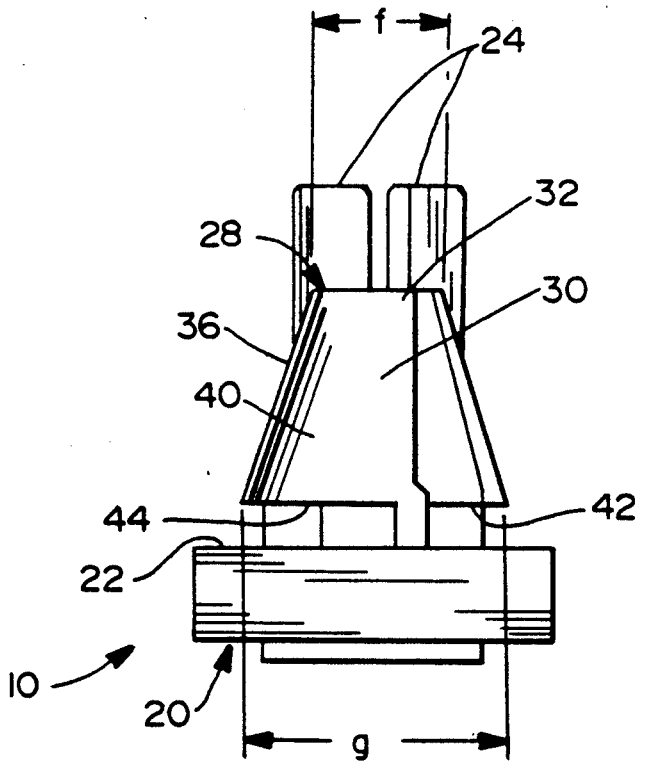
FIG. 2 is a side elevational view of the electrical connector shown in FIG. 1.

An electrical connector housing incorporating the panel mount of the subject invention is illustrated in FIGS. 1–4 and is identified generally by the numeral 10. The housing 10 is unitarily molded from a plastic material such as nylon, and is constructed to be floatably mounted relative to a generally planar panel which is identified by the numeral 12 in FIG. 4. More particularly, the panel 12 is provided with opposed planar surfaces 14 and 16 defining a thickness "a" which, for example, may be approximately 0.09 inch. The panel 12 is provided with a pair of mounting apertures extending therethrough, with one such aperture being depicted in FIG. 4, and being identified by the numeral 18. The mounting aperture 18 in the panel 12 defines a diameter "b", the relative dimensions of which will be described in greater detail below The panel 12 further is provided with a mating aperture (not shown) extending therethrough and disposed intermediate a pair of the mounting apertures 18. The mating aperture (not shown) is dimensioned to receive the mating portion of the electrical connector housing 10 as explained further herein.

The electrical connector housing 10 is molded to include a mounting flange 20 having a generally planar mounting surface 22 for mounting in face-to-face relationship with the surface 16 of the panel 12. The electrical connector housing 10 further comprises mating structures 24 extending from the mounting face 22 of the mounting flange 20. The mating structures 24 are formed to define a plurality of terminal receiving cavities 26 extending therethrough for lockingly receiving electrically conductive terminals (not shown) therein. The mating structures 24 are receivable in the correspondingly configured mating aperture (not shown) in the panel 12 depicted in FIG. 4. The mating structures 24 are configured such that the electrical connector housing 10 defines a receptacle. It is to be understood, however, that the floating panel mount structures described herein can be incorporated into a plug connector housing.

The electrical connector housing 10 further comprises a pair of floating panel mounts 28 disposed on opposite respective sides of the mating structure 24 and extending from the mounting face 22 of the mounting flange 20. More particularly, each floating panel mount comprises a support post 30 extending unitarily from the mounting flange 20 and generally orthogonal to the mounting face 22 thereof. The support post 30 defines a major cross-sectional dimension "c" which is less than the diameter "b" of the mounting aperture 18 in the panel 12. The support post 30 extends from the mounting face 22 of the flange 20 to a top 32 to define a height "d" which is substantially greater than the thickness "a" of the panel 12. However, the height "d" of the support post 30 preferably is less than the overall height of the mating structures 24 to minimize the height or profile of the housing 10.

Each floating panel mount 28 further includes a pair of resiliently deflectable generally helically spirally formed vanes 34 and 36 extending in generally opposite directions from generally opposite sides of each respective support post 30. The vanes 34, 36 extend from a location generally adjacent the top 32 of the support post 30 to a location spaced from the mounting surface 22 of the flange 20 by a distance "e" which preferably is equal to or slightly greater than the thickness "a" of the panel 12. The vanes 34 and 36 of each floating panel mount 28 define a minor cross-sectional dimension "f" at locations thereon generally adjacent the top 32 of the support post 30. The minor cross-sectional dimension "f" is less than the diameter "b" of the mounting aperture 18 in the panel 12. The vanes 34 and 36 gradually flare to wider dimensions at locations thereon spaced further from the top 32 of the support post 30. More particularly, portions of the vanes 34 and 36 closest to the mounting face 22 of the mounting flange 20 define a major cross-sectional dimension "g" which is greater than the diameter "b" of the mounting aperture 18 in the panel 12. The vanes 34 and 36 thus define generally frusto-conical shaped outer surfaces 38 and 40 respectively. The vanes 34 and 36 further define panel engaging bottom surfaces 42 and 44 respectively. The bottom surfaces 42 and 44 are formed to lie generally in a plane extending parallel to the mounting face 22 of the mounting flange 12, and are spaced therefrom by dimension "e" referred to above and illustrated most clearly in FIG. 3.

Figure 4:
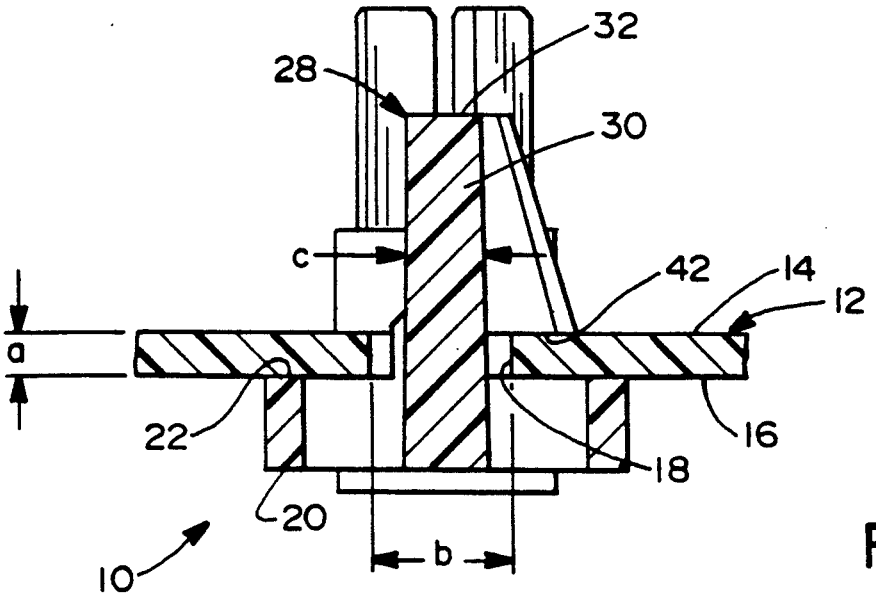
FIG. 4 is a Cross-sectional view taken along line 4—4 in FIG. 1 and showing the connector mounted to a panel.
Figure 3:
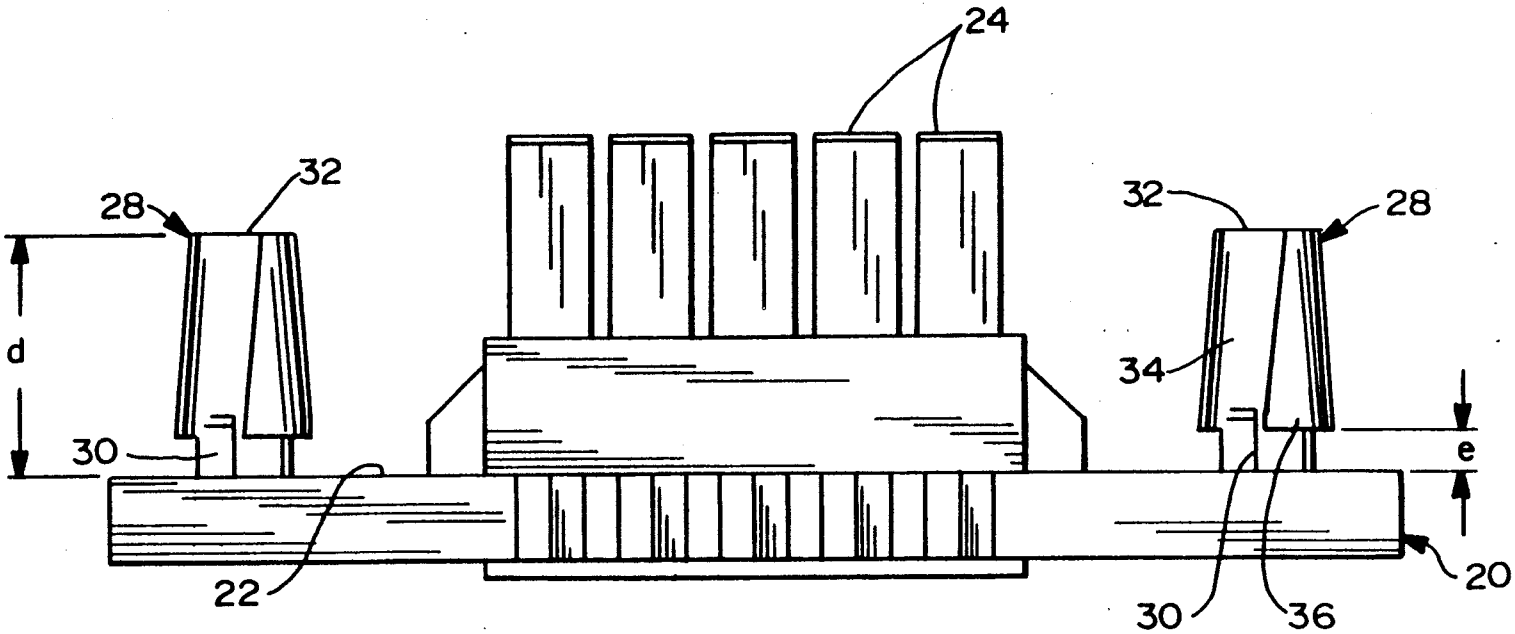
FIG. 3 is a front elevational view of the electrical connector shown in FIG. 1.

The vanes 34 and 36 are formed to define relatively narrow thicknesses extending inwardly from the outer generally frustum shaped surfaces 38 and 40. More particularly, the thickness of each vane 34, 36 at locations thereon generally adjacent the top 32 of the support post 30 preferably is approximately 0.02 inch, and may taper to slightly greater thicknesses at locations spaced further from the top. The relatively thin construction of each vane 34, 36 enables the vanes to be readily collapsed generally helically inwardly as the floating panel mounts 28 are urged into the mounting apertures 18 of the panel 12. More particularly, the movement of the electrical connector housing 10 toward the panel 12 generates ramping forces between the tapered outer surfaces 38 and 40 of the vanes 34 and 36 against the periphery of the mounting aperture 18 in the panel 12. The ramping forces against the outer surfaces 38 and 40 of the relatively thin vanes 34 and 36 will cause the inward generally helical collapsing of the vanes 34 and 36 toward the support post 30. This gradual inward helical collapsing of the vanes 34 and 36 enables the mounting flange 20 of the electrical connector housing 10 to be advanced toward the panel 12. As the mounting surface 22 of the flange 20 approaches the surface 16 of the panel 12, the bottom surfaces 42 and 44 of the vanes 34 and 36 respectively will clear the surface 14 of the panel 12 as illustrated most clearly in FIG. 4. This movement of the vanes 34 and 36 beyond the surface 14 of the panel 12 will enable the vanes 34 and 36 to resiliently return to their original position. As noted above, the major cross-sectional dimension "g" defined by the portions of the vanes 34 and 36 adjacent the bottom surfaces 42 and 44 thereof significantly exceeds the width "b" of the mounting aperture 18 in the panel 12. Thus, the panel 12 will be effectively trapped between the mounting surface 22 of the flange 20 and the bottom surfaces 42 and 44 of the vanes 34 and 36. However, as shown in FIG. 4, and as explained above, the support post 30 defines a width "c" which is substantially less than the diameter "b" of the mounting aperture 18 in the panel 16. Thus, the entire electrical connector housing 10 may float radially relative to the panel 12 in response to forces exerted during mating, thereby ensuring proper alignment for mating the electrical connector housing 10 with another electrical connector housing.

As noted above, it is desirable to prevent excessive backup of the electrical connector housing 10 in response to forces exerted during mating. In this context, backup refers to movement of the electrical connector housing 10 in a direction that would space the mounting face 22 of the mounting flange 20 further away from the face 16 of the panel 12. Such backup of the electrical connector housing 10 could prevent complete mating.

Backup is substantially prevented by the vanes 34 and 36 of the electrical connector housing 10.

In summary, a floating panel mount is provided for an electrical connector. The floating panel mount may be unitarily molded with the electrical connector housing to extend from a generally planar mounting flange thereof. The floating panel mount includes a support post extending generally orthogonal to the mounting flange of the electrical connector housing, with a pair of helically inwardly collapsible vanes extending from opposite sides of the support post. The vanes are configured to be helically inwardly collapsed against the support post in response to forces exerted on outer portions of the vanes as the floating panel mounts are urged into the mounting aperture of a panel. After complete mounting, the panel will be engaged between the mounting flange of the electrical connector housing and bottom edges of the vanes. This engagement prevents backup during mating, but permits radial float of the electrical connector housing relative to the panel. The vanes preferably are formed to be of a generally helical configuration with generally frustum shaped outer surfaces to permit the inward helical collapsing of the vanes relative to the support post during mounting of the electrical connector housing to a panel.

While the invention has been described with respect to certain preferred embodiments, it is apparent that various changes can be made without departing from the scope of the invention as defined by the appended claims. In particular, the floating panel mount need not be unitarily molded with the electrical connector housing but may define a separate structure used in combination with an electrical connector housing.

I claim:

1. A floating panel mount for mounting an electrical connector to a panel, said panel having at least one mounting aperture therein, said floating panel mount comprising:

a mounting flange;

a support post extending from said mounting flange, said support post defining a cross-sectional dimension less than the cross-section dimension of the mounting aperture and having a length greater than the thickness of the panel; and a pair of spiral vanes extending along substantially the entire length of said support post at locations thereon spaced from said mounting flange, said spiral vanes extending generally helically about said support post in spaced relationship thereto, portions of said spiral vanes in proximity to the mounting flange defining a cross-sectional dimension greater than the cross-sectional dimension of the mounting aperture and significantly greater than the cross-sectional dimension of said support post, each said spiral vane having an outer surface, said outer surfaces cooperating to form a generally frusto-conical shape, said spiral vanes being resiliently deflectable inwardly toward said support post to define a cross-sectional dimension less than the cross-sectional dimension of the mounting aperture, whereby the spiral vanes are deflectable inwardly to permit passage of the spiral vanes through the mounting aperture and are resiliently returnable to an undeflected condition with the panel floatably engaged between the mounting flange and the spiral vanes.

2. A floating panel mount as in claim 1 wherein the spiral vanes are spaced from the mounting flange by a distance approximately equal to the thickness of the panel.

3. A floating panel mount as in claim 1 wherein the spiral vanes are spaced from the mounting flange by a distance slightly greater than the thickness of the panel.

4. A floating panel mount as in claim 1 wherein said spiral vanes are tapered to define a minor width at locations thereon most distant from the mounting flange and to define a major width at locations thereon in proximity to the mounting flange, said minor width being less than the cross-sectional dimension of the mounting aperture, and the major width being greater than the cross sectional dimension of the mounting aperture.

5. A floating panel mount as in claim 4 wherein the electrical connector comprises a housing, said floating panel mount being unitarily molded with the housing.

6. A floating panel mount as in claim 1 comprising a pair of said support posts extending from said mounting flange at spaced apart locations, each said support post comprising a pair of said spiral vanes extending helically thereabout.

7. A floating panel mount as in claim 6 wherein each said spiral vane includes a panel engaging surface defining the portion of said vane closest to the mounting flange, the panel engaging surface being spaced from the mounting flange by a distance substantially corresponding to the thickness of the panel.

8. A floating panel mount as in claim 1 wherein the spiral vanes are spaced from the mounting flange by a distance slightly greater than the thickness of the panel.

9. A floating panel mount as in claim 8 wherein said spiral vanes are generally opposed from each other.

10. A floating panel mount as in claim 9 wherein said spiral vanes are continuously curved.

11. An electrical connector housing for floatable mounting to a panel, said panel comprising a pair of spaced apart mounting apertures extending therethrough, each said aperture defining a cross-sectional dimension, said electrical connector housing comprising a pair of spaced apart floating panel mounts for engaging the mounting apertures of the panel and permitting limited float between the electrical connector housing and the panel, each said floating panel mount comprising:

a generally planar mounting flange for engaging one surface of the panel;

a support post extending substantially perpendicularly from the mounting flange for a distance greater than the thickness of the panel, said support post having a generally circular cross-section and having a diameter that is less than the cross-sectional dimension of the mounting aperture; and a pair of spiral vanes extending along substantially the entire length and from generally opposite sides of the support post at locations thereon spaced from the mounting flange, each said spiral vane extending generally helically about said support post and being resiliently deflectable inwardly toward said support post, each said spiral vane having an outer surface, said outer surfaces cooperating to form a generally frusto-conical shape, said spiral vanes being tapered to define a minor width at locations thereon most distant from the mounting flange and to define a major width at locations thereon closer to the mounting flange, the minor width defined by the spiral vanes being greater less than the cross-sectional dimension of the mounting apertures, the major width defined by said spiral vanes being greater than the cross-sectional dimension defined by the mounting aperture.

12. An electrical connector housing as in claim 11 wherein each said vane includes a panel engaging surface defining the portion of said spiral vane closest to the mounting flange, the panel engaging surface being spaced from the mounting flange by a distance substantially corresponding to the thickness of the panel.

13. A floating panel mount as in claim 11 wherein the spiral vanes define a width in their inwardly deflected condition that is less than the cross-sectional dimension of the mounting aperture.

14. An electrical connector housing as in claim 11 wherein said major width is substantially greater than the cross-sectional dimension of said support post.

15. An electrical connector housing as in claim 14 wherein said spiral vanes are continuously curved.

16. A floating panel mount for mounting an electrical connector to a panel, said panel having at least one mounting aperture therein, said floating panel mount comprising:

a mounting flange;

a support post extending from said mounting flange, said support post having a cross-sectional dimension less than the cross-sectional dimension of the mounting aperture and a length greater than the thickness of the panel;

a generally frusto-conically shaped securing member extending generally about said support post in spaced relationship thereto, said securing member having first and second ends, said first end being adjacent to but spaced from the mounting flange by a distance slightly greater than the thickness of the panel, the cross-sectional dimension of said first end being greater than the cross-sectional dimension of the mounting aperture, said securing member being resiliently deflectable inwardly toward said support post to define a cross-sectional dimension less than the cross-sectional dimension of the mounting aperture; and said securing member being comprised of at least one vane, said at least one vane being attached to said support post along substantially the entire length of said support post spaced from said mounting flange.

17. A floating panel mount as in claim 16 wherein each said at least one vane is continuously curved.

18. A floating panel mount as in claim 17 further comprising a pair of said support posts extending from said mounting flange at spaced apart locations.

19. A floating panel mount as in claim 18 wherein each said support post has at least two vanes extending along each of said support posts, said vanes of each said support post being located substantially equidistant around the circumference of said support post.

20. A floating panel mount as in claim 19 wherein each said vane extends between said first and second ends of said securing member and wherein said vane decreases in thickness between said first and second ends.

* * * * *